US007367709B2

(12) United States Patent
Ki

(10) Patent No.: US 7,367,709 B2
(45) Date of Patent: May 6, 2008

(54) PACKAGING CONTAINER WITH CONTENTS MIXING STRUCTURE

(75) Inventor: Keun-Seo Ki, Kyonggi-Do (KR)

(73) Assignee: Tani Industry Co., Ltd., Tokyo (JP)

( * ) Notice: Subject to any disclaimer, the term of this patent is extended or adjusted under 35 U.S.C. 154(b) by 540 days.

(21) Appl. No.: 10/509,490

(22) PCT Filed: Nov. 21, 2002

(86) PCT No.: PCT/JP02/12211

§ 371 (c)(1),
(2), (4) Date: May 5, 2005

(87) PCT Pub. No.: WO03/082703

PCT Pub. Date: Oct. 9, 2003

(65) Prior Publication Data

US 2005/0174881 A1 Aug. 11, 2005

(30) Foreign Application Priority Data

Mar. 29, 2002 (KR) ..... 20-2002-0009441 U
Jul. 12, 2002 (KR) ..... 20-2002-0020977 U

(51) Int. Cl.
*B65D 25/06* (2006.01)

(52) U.S. Cl. ..... 366/130; 206/221

(58) Field of Classification Search ..... 366/130, 366/190–191; 206/219, 221; 222/142.1, 222/142.2, 145.5, 145.6, 209; 215/DIG. 8
See application file for complete search history.

(56) References Cited

U.S. PATENT DOCUMENTS 3,655,096 A * 4/1972 Easter ..... 206/222
5,692,644 A * 12/1997 Gueret ..... 215/DIG. 8
2003/0052019 A1* 3/2003 Song ..... 206/219
2005/0174881 A1* 8/2005 Ki ..... 366/130
2006/0219736 A1* 10/2006 Revenu ..... 206/219

FOREIGN PATENT DOCUMENTS

| | | | |
|---|---|---|---|
| JP | 07-010172 | | 1/1995 |
| JP | 9-501640 | | 2/1997 |
| JP | 2000-313487 | | 11/2000 |
| JP | 2007-91286 | * | 4/2007 |

OTHER PUBLICATIONS

U.S. Patent No. 5,398,846 Abstract (Mar. 1995).

* cited by examiner

*Primary Examiner*—Charles E. Cooley
(74) *Attorney, Agent, or Firm*—Antonelli, Terry, Stout & Kraus, LLP.

(57) ABSTRACT

A pump container comprising a container body, discharging pump and a movable bottom part, configured so as to prevent air from being taken into the container body by allowing, when contents are discharged by pumping operation, the bottom part to move upward by the volume of the contents discharged by pumping operation, wherein the pump container comprises a main container and an auxiliary container separated from the main container by a separating mechanism, and through operation, the separating mechanism allows the constitution of a communication between the main container and the auxiliary container to allow mixing of the contents of the both containers.

8 Claims, 17 Drawing Sheets

PACKAGING CONTAINER WITH CONTENTS MIXING STRUCTURE

TECHNICAL FIELD

The present invention relates to a packaging container with contents mixing structure.

BACKGROUND ART

In recent years, so-called biocosmetic products are being produced and sold widely. Biocosmetic products, typically, are cosmetic products that contain constituents which can be naturally produced by living organisms but are produced through the use of biotechnology. Biotechnology is a new technology which is meant to create new living organisms through, e.g., genetic recombination, gene fusion, and clone technology which is a mass-replication technique, and to make the use of them in food and pharmaceutical production.

Through the application of the biotechnology, active constituents of animals and plants that could have earlier been extracted only by a small amount, can now be mass-produced through tissue culture, which is a basic technique of the biotechnology, and the development of cosmetics that contain such constituents compounded to suite them to human skins, is being underway.

For example, a lip color containing shikonin, which is a pigment obtained from the root of Lithospermum erythrorhizon Sieb. Et Zucc., is one successful example realizing the mass-production and commercialization through the cultivation of shikonin which could have conventionally been obtained only in an extremely small amount.

Furthermore, there are bio-essence products compounded with hyaluronic acid and γ-linolenic acid that are the constituents of the dermal layer of skin and enhance moisturizing action of skin. These constituents are also commercialized through the use of mutants having high productivity. These biocosmetic products differ from artificially synthesized conventional cosmetics, in that they use substances that are naturally produced by living organisms, and they are characterized as being harmless and safe.

Also, they are highly esteemed by consumers as natural cosmetic products. Furthermore, since they can use constituents having favorable effects to skins and being biotechnologically produced through cultivation using replications or clones, in contrast to the passive concept of general cosmetics whose main object is to control skins through color tone makeup, they have advantages as active-concept cosmetics that can control skins by maintaining the skin balance as functional cosmetics, as well as improving various skin problems such as dead skin cells, enlarged pores, wrinkles, pigmented spots, dusts etc.

These functional cosmetic products, such as biocosmetics, can give desired effects even in a small volume, so that generally, a small amount of a primary constituent as a primary content is used with a large amount of a supplementary constituent as a supplementary content.

However, if such a functional cosmetic product is sold with the primary and supplementary constituents pre-mixed, such as in conventional cosmetics like creams, or detergents such as gel-type shampoos and conditioners, and liquid soaps, the primary constituent that is susceptible to direct sunlight or ambient conditions would instantly react, so that its storage life would be extremely shortened, and as a result, the distribution period of the product is shortened, making it's price too expensive for general consumers to purchase it.

As an example, in a case where a product containing retinol (vitamin A) as one of the primary constituents mixed in a cosmetic product with a supplementary constituent is distributed and sold, there has been a problem that the distribution life of the cosmetic product would be shorter than the case where the cosmetic product as the primary constituent and retinol as a supplementary constituent are separately stored and used.

Furthermore, in a case of the packaging container of conventional cosmetic products in which a primary constituent and a supplementary constituent are mixed together, the contents of the container cannot fully be discharged from the container and used, so that even though there is an amount of the liquid contents remained within the container, the user must often purchase a new one, or discard it as it is. This causes the production of a large amount of waste that may cause environmental pollution as one of national issues, and also, discarding a usable portion without further using will promote a disbenefit at home.

In addition, since a layer of air is formed within conventional cosmetic containers, the portion of the cosmetic in contact with the air would easily change in its quality, there is a risk of promoting damages to the skins of users who used the cosmetic without knowing the change. When the cosmetic in this condition is not used for a long period of time, the user has no choice but to discard it without using it because of possible oxidization and corruption of the cosmetic in the worst case.

Accordingly, an object of the present invention is to solve the above problems found in the conventional cases, and at the same time, to provide a packaging container with contents mixing structure which is distributed in a state where primary contents and supplementary contents are held separately within the one packaging container so that the primary and supplementary contents are mixed only when necessary to extend the distribution period of the product, and also, the supplementary contents stored separately within the packaging container are completely discharged after mixing it with the primary contents to provide economical use as well as to increase the reliability of the product, thereby avoiding the environmental pollution beforehand.

DISCLOSURE OF THE INVENTION

In order to achieve the object, the present invention provides a packaging container with contents mixing structure, which is a pump container comprising a container body, a discharging pump and a movable bottom part and is configured so as to prevent the formation of an air layer within said container body by allowing said bottom part to move upward by a volume of contents discharged as a result of discharging of the contents by pumping operation, wherein said packaging container comprises a main container and an auxiliary container separated from said main container by a separating means, said separating means includes a communicating means which allows communication between said main container and said auxiliary container and is switchable between a separating state and a communicating state, so that contents of said auxiliary container flow into said main container to allow mixing of contents of the both containers during said communicating state.

Also the present invention provides a packaging container with contents mixing structure, which is a pump container comprising a container body, a discharging pump and a movable bottom part and is configured so as to prevent the formation of an air layer within said container body by allowing said bottom part to move upward by a volume of contents discharged as a result of discharging of the contents by pumping operation, wherein said packaging container comprises a main container and an auxiliary container separated from said main container by a separating means, said separating means includes a communicating means which allows communication between said main container and said auxiliary container and is switchable between a separating state and a communicating state, wherein said separating state is maintained during the course of distribution, and said communication state is temporarily assumed at the time of use to allow contents of said auxiliary container to flow into said main container thereby to mix contents of the both containers, and then the communication state is switched back to said separating state during use.

Also, in one embodiment, the packaging container with contents mixing structure according to the present invention is characterized in that said main container and said auxiliary container, respectively, are cylindrical containers separately formed, and are provided serially on a common center line, with a sealing member interposed therebetween, and have their respective openings facing each other, and are coaxially mutually rotatable, and matching and mismatching of the openings through the rotational operation allow switching between an open state and a closed state.

Also, in one embodiment, the packaging container with contents mixing structure according to the present invention is characterized in that the container body has flexibility.

BEST MODE FOR CARRYING OUT THE INVENTION

A packaging container with content mixing structure of the present invention (herein after referred to as the container) will now be explained in detail with reference to the attached figures.

Embodiment 1

FIG. 1 shows a cross-sectional view of the first embodiment of the container, in its distribution state. The container 1 comprises the housing 2, the primary contents filling means 3 and the pump member 4, wherein the pump member 4 is covered by the cap 5.

The housing 2 is an elongated cup-shaped cylindrical container, which has the through hole 6 at its lower end which forms the bottom, and an open end at its top. This housing 2 is preferably formed of a synthetic resin. The same applies to the motion-support tube 8 and the primary contents filling tube 14 that will later be described.

On the inner sidewall of the housing 2, the movable bottom part 7, which moves up and down while keeping a hermetical seal, is slidably provided. The peripheral side of the movable bottom part 7 is formed of an elastic material, such as rubber, that makes close contact with the inner wall surface of the housing 2, providing a sealing property to prevent the leakage of the contents of the container. It is initially positioned at the inner bottom of the housing 2, and is configured to move upward along the inner wall of the housing 2 at the time of use according to the amount consumed as the mixture of the contents of the housing 2 are discharged by a pumping operation. That is, it is moved upward by the negative pressure that would occur within the housing 2 if the bottom part cannot move, and that prevents the formation of an air layer within the housing 2.

To the opening of the top end of the housing 2, the motion-support tube 8 is engaged. FIGS. 2 through 4 are, respectively, the vertical cross-sectional view, plan view and bottom plan view of the motion-support tube 8. The motion-support tube 8 is formed in a shape of cup-like tube having an open top and a bottom, that is shallower than the housing 2, and its outer edge is forming the flange 9 which protrudes outwardly. In the center of its bottom plane, the outlet hole 10 is formed, to which the bottom part of the pump member 4 is engaged. Beside the outlet hole 10, the mixing-communication hole 11 is formed at a position between the outlet hole 10 and the inner wall, at which it never communicate with the outlet hole 10. The sealing ring 12 is engaged to the top end of the mixing-communication hole 11 so as to prevent the outflow of the primary contents A located at the filling concave section 15 when it is engaged with the later-described primary contents filling tube 14. Furthermore, there is the upward protrusion 13 formed on its one side to limit the rotation range of the motion-support tube 8, at the lower end of the primary contents filling tube 14. Also, on its bottom outer periphery, spline-type engagement trenches (or ridges) are formed over the entire periphery in order to limit the interdependent rotation through the engagement with the housing 2. The housing 2 of course has engagement ridges (or trenches), although not illustrated, which are engageable with the above-described engagement trenches (or ridges).

Within this motion-support tube 8, the primary contents filling tube 14 is further engaged. FIGS. 5 through 7 are, respectively, the vertical cross-sectional view, plan view and bottom plan view of the primary contents filling tube 14 of this container. As shown in FIG. 5, the primary contents filling tube 14 is formed in a tubular shape which is somewhat deeper than the motion-support tube 8, and has the tube-insertion hole 16 at its center section, to which the lower end of the pump member 4 is engaged. By this tube insertion configuration, double inner walls are formed, inside of which is partially separated as shown in FIG. 7 to form the filling concave section 15 as a room which is filled with the primary contents A. This filling concave section 15 has no bottom, and opening 20 is provided. Furthermore, the upper large-diameter portion 18 has a diameter larger than the lower portion through the stepped portion 17, and the projected line 19 is formed over the entire periphery, to which the later-described supporting tube 22 is engaged. In FIG. 7, the portion 21 is a plane section, and it is configured to close the mixing-communication hole 11 when it overlaps with the mixing-communication hole 11 of the motion-support tube 8.

The primary contents filling tube 14 is inserted rotatably while being in close contact with the motion-support tube 8, thereby constituting the primary contents filling means 3. Accordingly, this primary contents filling means 3 is, as well as constituting the auxiliary container filled with the primary contents A, configured to allow switchable operation of the separating means and the communicating means with the main container that is constituted by the housing 2.

Furthermore, the supporting tube 22 of the pump member 4, which is formed to cover the large-diameter portion 18 of the primary contents filling means 3, is engaged. FIGS. 8 through 10 show, respectively, the vertical cross-sectional view, plan view, and bottom plan view of this supporting tube 22. Provided over the supporting tube 22 is the pump member 4, which is formed in the top-bottom direction and configured to externally discharge the mixed contents C by external pressure, and the cap 5 is further provided to protect the pump member 4. The cap 5 is made of a synthetic resin material, and it is closely affixed to the outer surface of the supporting tube 22 to prevent impurities from flowing from the outside into the pump member 4 during the storage of the container 1. In FIG. 8, the numeral 23 represents the inner diameter section operating as a stroke guide of the pump head 26 shown in FIG. 1, and numeral 24 represents a stopper thereof.

The filling concave section 15 of the contents filling means 3 is filled with the primary contents A, and the housing 2 is filled with the supplementary contents B. The primary contents A filling the filling concave section 15 of the primary contents filling tube 14 are, e.g., vitamin C, foot ulcer medicine (E.F.G) etc., and since the primary contents A are substances that are easily transformed or deteriorated by alkalis, water and ultraviolet ray, it is better to provide them in a powdery form such as granules or fine particles. As for the supplementary contents B, a liquid, such as distilled water or alcohol, is used.

The use of the packaging container constructed in the above-described manner is as follows.

In assembling the packaging container 1, after the pump member 4 is first engaged into the supporting tube 22, the cap 5 is connected to the top end of the supporting tube 22, and the top end of the primary contents filling tube 14 is inserted into the bottom end of the supporting tube 22, thereby constituting a pump unit.

The pump unit in this state is then inverted so as to direct the opening 20 of the filling concave section 15, which initially was opened downwardly, to face upward, and then the primary contents A in a powdery state such as vitamin C etc. is filled into the filling concave section 15 of the primary contents filling tube 14. Then the inverted motion-support tube 8 is inserted into the top end of the supporting tube 22 that has previously been inverted by 180 degree, and at the same time, as shown in FIG. 11 which is a plan view of a relevant section showing the positions of the primary contents filling tube 14 and the motion-support tube 8 at the time of communication state, the mixing-communication hole 11 of the motion-support tube 8 is removed from the opening section 20 of the primary contents filling tube 14, and placed to the position matching to the plane section 21, thereby sealing the filling concave section 15. That is, since the bottom end of the mixing-communication hole 11 is tightly sealed by the sealing ring 12 of the motion-support tube 8, the primary contents A of the filling concave section 15 of the primary contents filling tube 14 would be held still without any leak.

Next, the movable bottom part 7 is positioned at the inner lower end of the housing 2, and the housing 2 is filled with liquid supplementary contents B such as distilled water up to the position of the lower end surface of the motion-support tube 8. The supporting tube 22 and the bottom end of the motion-support tube 8 to which the primary contents filling tube 14 is affixed are inserted into the top end of the housing 2 filled with the supplementary contents B to provide the seal, thereby completing the structure.

Upon this time, when the supplementary contents B have an anaerobic nature and are susceptible to degradation when exposed to the air, or when the primary contents A are completely soluble in the supplementary contents B so that the volume of the mixed contents would be no different from the original volume of the supplementary contents B, the filling amount of the supplementary contents B is preferably held to retain the level as high as possible as long as that does not let the contents flow out of the housing 2, in order to prevent the formation of an air layer within the housing 2. However, in a different condition, for example, when the primary contents A are a liquid and mixing it with the supplementary contents B would result in an increased volume, then an air layer of the same volume as that of the primary contents A within the filling concave section 15 may be formed.

The container 1 assembled in this manner is distributed while the supplementary contents B of the housing 2 and the primary contents A of the filling concave section 15 of the primary contents filling tube 14 are separated from each other by the motion-support tube 8 before it is purchased by a user.

After it is purchased by a user, the user, in order to use this container 1, holds the housing 2 by one hand, and rotates the periphery section 25 of the supporting tube 22 by the other hand. FIG. 12 is a plan view of a relevant part showing the rotational positions of the primary contents filling tube 14 and the motion-support tube 8 when the container is in a mixing state. As shown in the figure, the mixing-communication hole 11 of the motion-support tube 8 is positioned at the opening section 20 at the lower end of the filling concave section 15, thereby providing communication and resolving the sealing of the filling concave section 15. The primary contents A filling the filling concave section 15 then flow into the housing 2 through the mixing-communication hole 11 as shown in FIG. 13, thus, are mixed with the supplementary contents B to generate the mixed contents C. In order to mix promptly to complete the mixed contents C, the user may shake the housing 2 up and down several times. Rotating, once again, the periphery section 25 of the supporting tube 22 to rotate the motion-support tube 8 and to adjust the mixing-communication hole 11 to match with the plane section 21 of the primary contents filling tube 14 will close the mixing-communication hole 11 and seal the filling concave section 15.

With the above configuration, any air layer won't be formed within the housing 2, and degradation or corruption of the mixed contents C will not occur easily.

FIG. 14 is the vertical cross-sectional view of the container in a configuration at the time of use. The pump member 4 can then be pushed to have the mixed contents C discharged.

However, in a case where mixing both the contents together according to the above description causes the increase in the volume of the mixed contents C from the volume of the supplementary contents B, the mixed contents C would also be present within the filling concave section 15 of the primary contents filling tube 14, so that it is necessary to provide air in a same volume as that of the filling concave section 15 by an additional means for filling the filling concave section 15 with air, and then rotate the motion-support tube 8 again to seal the filling concave section 15 of the primary contents filling tube 14 before using it. In this way, the portion of the mixed contents C left within the filling concave section 15 can be used without being left behind.

Embodiment 2

FIG. 15 is the second embodiment of the present container, showing the vertical cross-sectional view representing the configuration during distribution.

The contents filling means 3 of the container 1 of the second embodiment includes the primary contents filling tube 14 having a larger capacity than that of the first embodiment. As for the closure setup of the mixing-communication hole 11 of the motion-support tube 8, a gasket 28 which rotates along with the primary contents filling tube 14 is interposed between the motion-support tube 8 and the primary contents filling tube 14.

FIGS. 16 and 17 are, respectively, the plan view and vertical cross-sectional view of the motion-support tube 8. As shown in FIG. 17, the motion-support tube 8 is formed in a cup-like shape, and an outlet hole 10 to which the lower end of the pump member 4 is engaged is formed at the center of its bottom plane, and beside it, there is a mixing-communication hole 11 formed between the outlet hole 10 and the inner wall in a position that does not cause it to communicate with the outlet hole 10. The upper portion forms a large-diameter section 18 enlarged outwardly, and it rotates along with the supporting tube 22. Furthermore, over the entire outer periphery of the lower portion, there are spline-type engagement trenches (or ridges) meant to be engaged with the housing 2 to control the interdependent rotation in a similar manner as in the first embodiment. The housing 2 of course has engagement ridges (or trenches) corresponding these trenches (or ridges), although not illustrated.

FIGS. 18 and 19 are, respectively, the plan view and vertical cross-sectional view of the primary contents filling tube 14. As shown in FIG. 19, the primary contents filling tube 14 is formed in a cup-like shape, and in its center section, it has a tubular section to which the pump member 4 is inserted, and by the presence of this tubular section, a filling concave section 15 is formed inside in a ring shape. Also, over the entire outer periphery of the upper portion, there are spline-type engagement trenches (or ridges) meant to be engaged with the supporting tube 22 to control the interdependent rotation in a similar manner as the aforementioned motion-support tube 8. The supporting tube 22 of course has engagement ridges (or trenches) corresponding to these trenches (or ridges) formed in its inner periphery, although not illustrated.

This primary contents filling tube 14 is filled with the primary contents A, which may be in a liquid state, however, are preferably in a form of micro particles, so as to provide a configuration where the mixed contents C would overflow the upper edge of the housing 2 to a certain extent when they are mixed with the supplementary contents B in a liquid state, to prevent air from flowing into the housing 2 upon sealing the housing 2.

FIGS. 20 and 21 are, respectively, the plan view and vertical cross-sectional view of the gasket adapter 27. The gasket adapter 27 is formed in a disk shape, and an insertion hole 34 is formed at its center which is located on the extension line of the coupling hole 29 of the gasket 28, and as well, the inlet hole 35 is formed between the insertion hole 34, which is located on the extension line of the motion through hole 31 of the gasket 28, and the peripheral section. Formed over the lower end of the periphery is a hook 36 protruding downwardly, which is meant to be hooked into the hooking concave section 33 of the gasket 28. This is inserted into the bottom inner side of the primary contents filling tube 14 to form the bottom, and the gasket 28 is provided to cover it and is allowed interdependent rotation with the primary contents filling tube 14.

FIGS. 22 through 24 are, respectively, the plan view, front view and vertical cross-sectional view of the gasket 28. The gasket 28 is formed in a disc shape, on which the coupling hole 29 is formed, to which the lower end of the cylindrical section of the primary contents filling tube 14 is press-inserted, and the upper end of the periphery protrudes upwardly and folded to form a coupling projected line 30 which engages with the bottom outer periphery of the primary contents filling tube 14. The material of the gasket 28 is preferably an elastic material, such as silicon rubber. Furthermore, the motion-communication hole 31 is formed between the coupling hole 29 and the peripheral section, and on the opposing bottom side, a bump 32 protruding downward is formed. This bump 32 is located at the upper end of the mixing-communication hole 11 of the motion-support tube 8, and is configured to protrude partly into the mixing-communication hole 11 to bring the inner surface of the motion-support tube 8 and the gasket 28 into close contact in order to prevent inadvertent damages to the supporting tube 22 during the distribution of the container 1. Inside the coupling projected line 30, many hooking concaves 33 (four of them illustrated in the figure) are formed. This gasket 28 provides a seal between the bottom end of the primary contents filling tube 14 and the inner bottom surface of the motion-support tube 8, and rotates interdependently with the primary contents filling tube 14.

The container 1 configured in the above-described manner is distributed and sold while the supplementary contents B of the housing 2 and the primary contents A of the filling concave section 15 are separated from each other as shown in FIG. 15.

Upon the time of use, a user may hold the housing 2 in one hand, and grip the outer periphery 25 of the supporting tube 22 with the other hand to rotate it by approximately 180 degrees. At this time, the primary contents filling tube 14, in which the upper outer surface is coupled with the inner surface of the supporting tube 22 through the rotation of the supporting tube 22, will interdependently rotate the gasket adapter 27 coupled to its bottom end and the gasket 28 on the inner surface of the motion-support tube 8, thereby aligning on one line the mixing-communication hole 11 of the motion-support tube 8, the motion-communication hole 31 of the gasket 28 and the communication hole 35 of the gasket adapter 27. In this state, the bottom surface of the filling concave section 15 is opened, so that the primary contents A flow into the housing 2 to be mixed with each other.

In this state the user may shake this container 1 to maximize the mixing, and by closing the filling concave section 15 of the primary contents filling tube 14 by rotating the supporting tube 22 again and separating it from the housing 2 as shown in FIG. 26, some amount of mixed contents C remaining within the filling concave section 15 would have to be discarded, but only the mixed contents C of the primary contents A and the supplementary contents B are held within the housing 2 without the presence of air.

In this way, the shortened duration of usable time due to oxidization and corruption of the mixed contents C can be avoided by preventing the mixed contents C within the housing 2 from being exposed to air, thereby maximizing the usable time period of the mixed contents C.

Every time the user pushes the pump member 4 to discharge the mixed contents C filling the housing 2, negative pressure occurs within the housing 2, and by that negative pressure, the movable bottom part 7 located at the bottom of the housing 2 rises to an extent corresponding to the discharged volume.

Embodiment 3

FIG. 27 is a vertical cross-sectional view of the third embodiment of the present invention. In this embodiment, while the primary contents filling means 3 is identical to that of the prior embodiments, the housing 2 for holding the supplementary contents B is substituted by a flexible container 37 such as a tube or bag-like container, and in the figure, it is illustrated as a bag-like container. In the case of the bag-like container, it may be the one received within the housing 2 explained in the respective prior embodiments.

In the case of a tube, since the tube itself has elasticity, and it works to restore its original shape after it is pressed, it is necessary to select a material having lower elasticity so that it has a restoring force lower than the negative pressure which occurs within the container body.

INDUSTRIAL APPLICABILITY

The packaging container with contents mixing structure of the present invention configured in the above-described manner allows the distribution period of the product to be extended by distributing it while the primary contents and the supplementary contents are stored separately from each other within the single packaging container, and having the primary contents and the supplementary contents mixed together for the use when needed.

Furthermore, since the corruption and oxidization of the mixed contents C due to the contact with air can be prevented by shielding the inflow of the external air into the housing 2, the extension of the consumption limit after mixing can be expected. Because the supplementary contents separately stored within the packaging container can fully be mixed with the primary contents, and discharged entirely, it can be used economically, and also the reliability of the product can be improved, and environmental pollution can be prevented beforehand.

Figure 1:
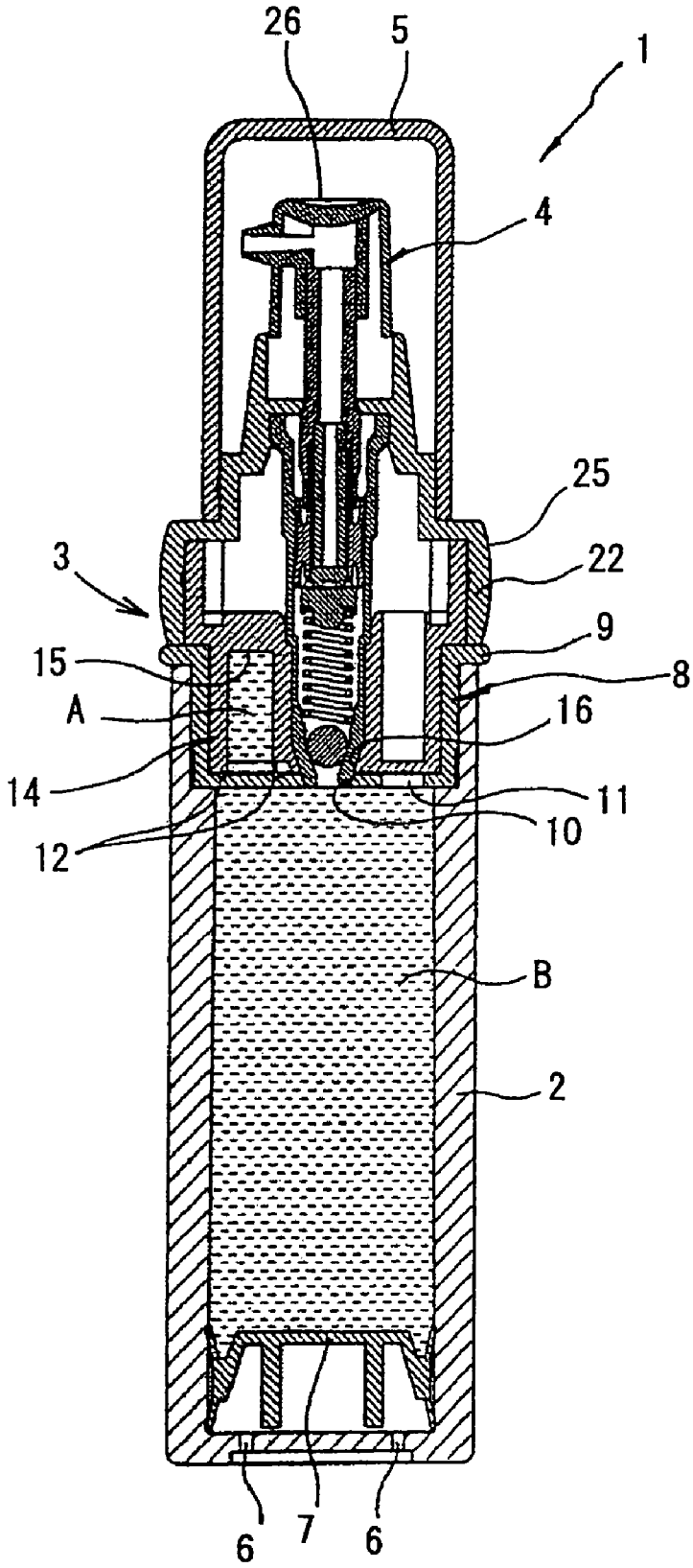
FIG. 1 is a vertical cross-sectional view illustrating the first embodiment of the present invention.
Figure 2:
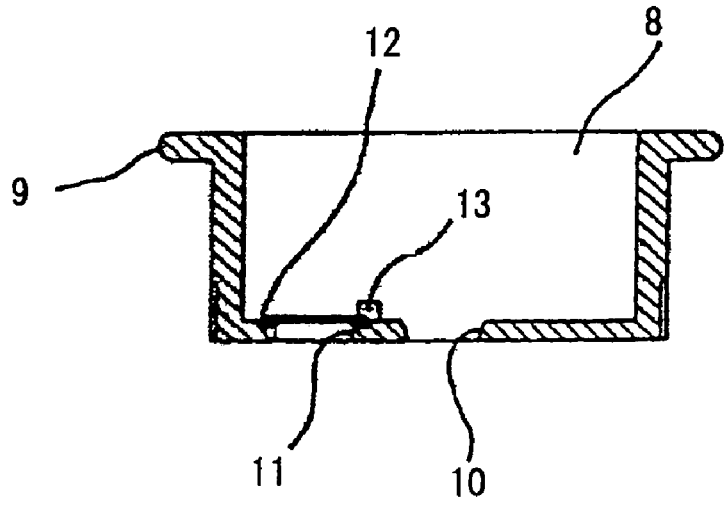
FIG. 2 is a vertical cross-sectional view of the motion-support tube.
Figure 3:
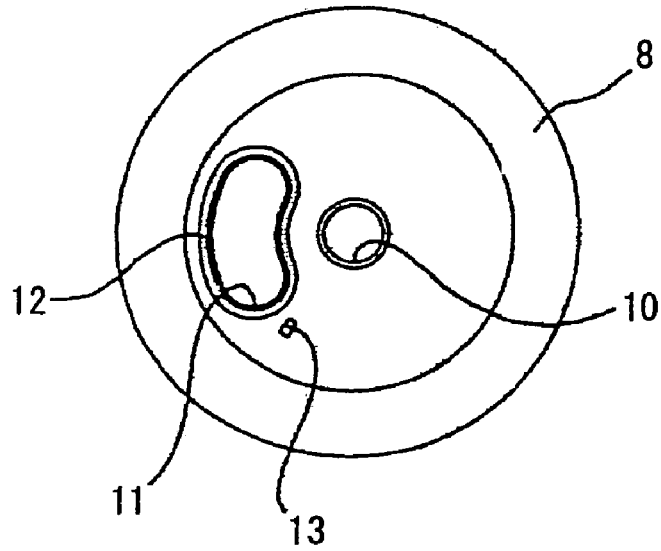
FIG. 3 is a plan view thereof.
Figure 4:
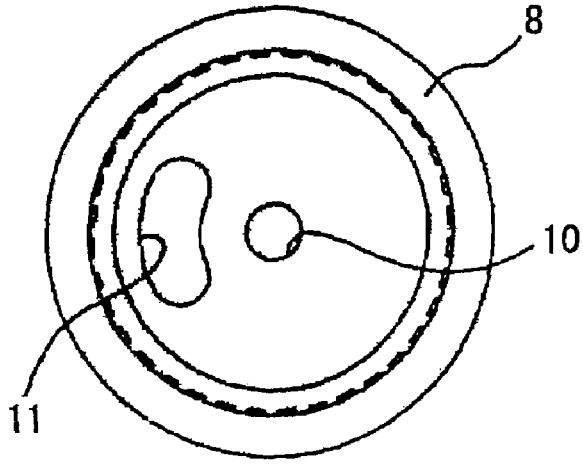
FIG. 4 is a bottom plan view thereof.
Figure 5:
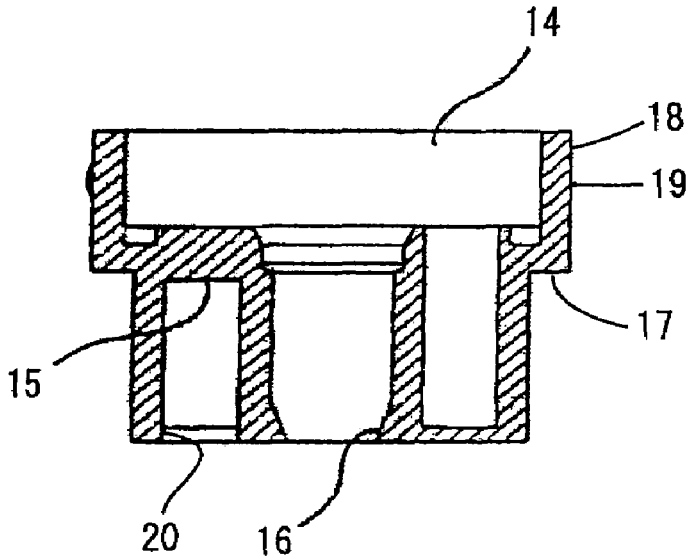
FIG. 5 is a vertical cross-sectional view of the primary contents filling tube.
Figure 6:
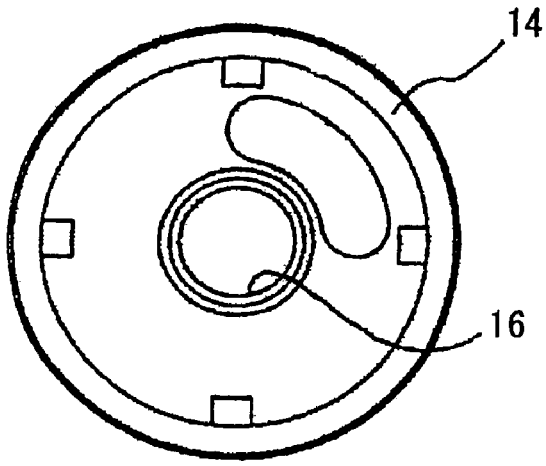
FIG. 6 is a plan view thereof.
Figure 7:
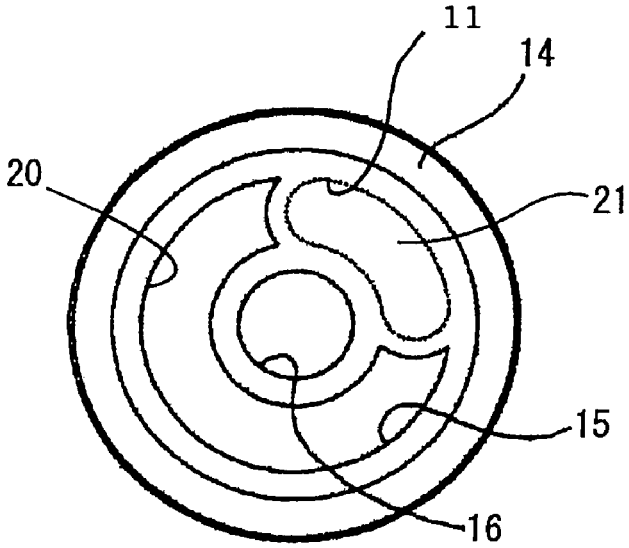
FIG. 7 is a bottom plan view thereof.
Figure 8:
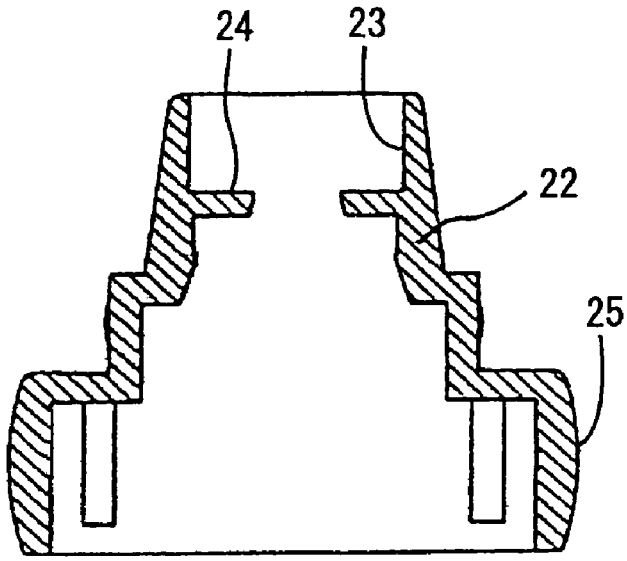
FIG. 8 is a vertical cross-sectional view of the supporting tube.
Figure 9:
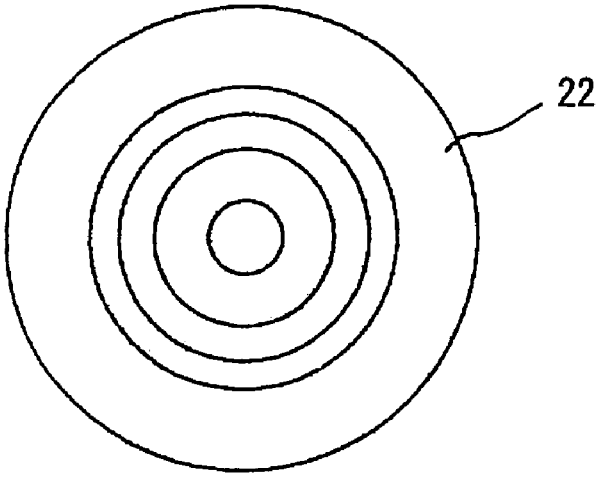
FIG. 9 is a plan view thereof.
Figure 10:
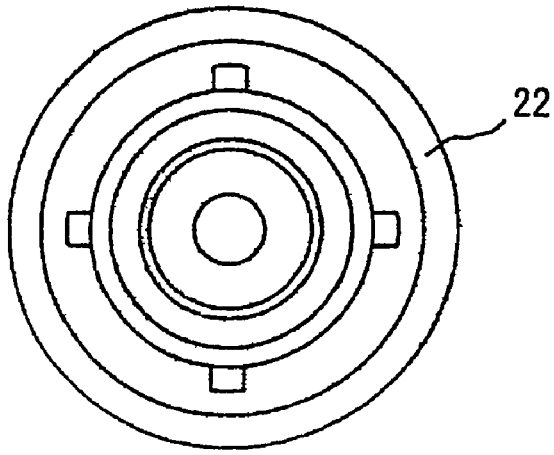
FIG. 10 is a bottom plan view thereof.
Figure 11:
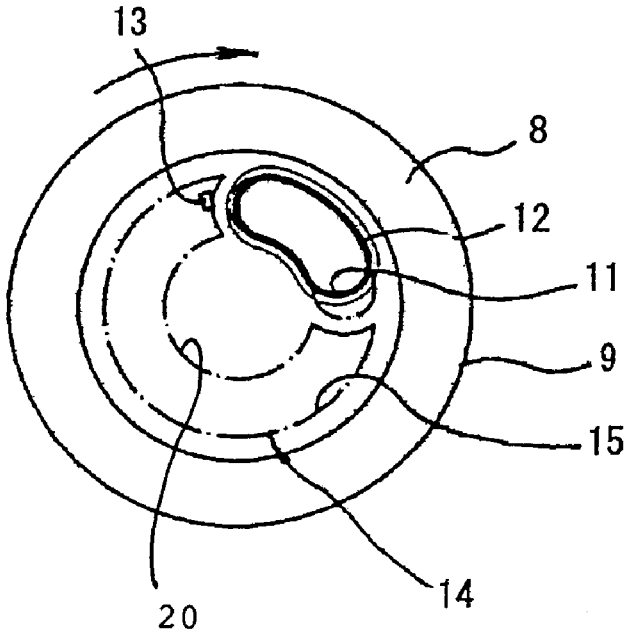
FIG. 11 is a plan view of a relevant section showing the positions of a primary contents filling tube and a motion-support tube during distribution.
Figure 12:
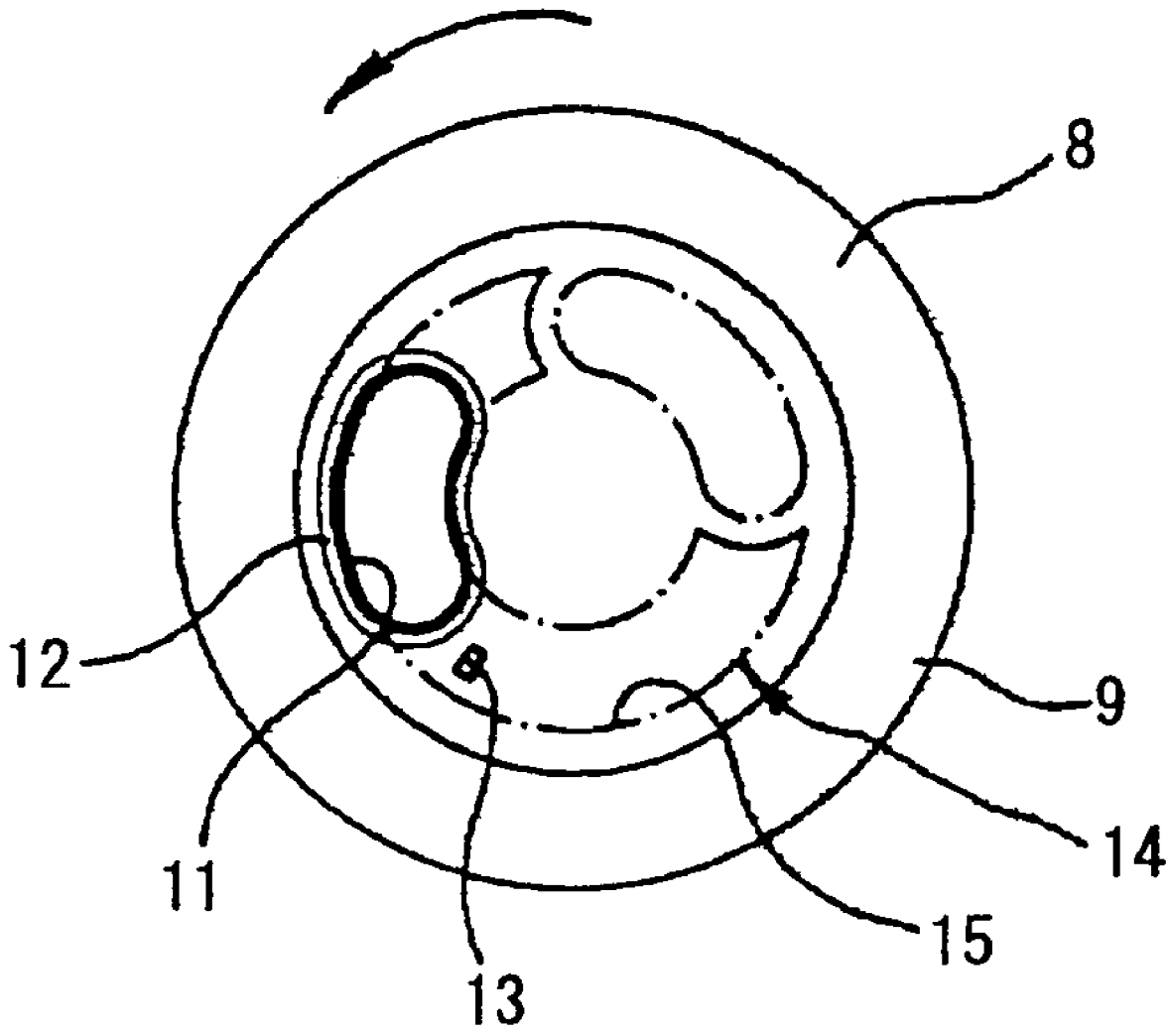
FIG. 12 is a plan view of a relevant part showing the rotational positions of the primary contents filling tube and the motion-support tube at the time of mixing.
Figure 13:
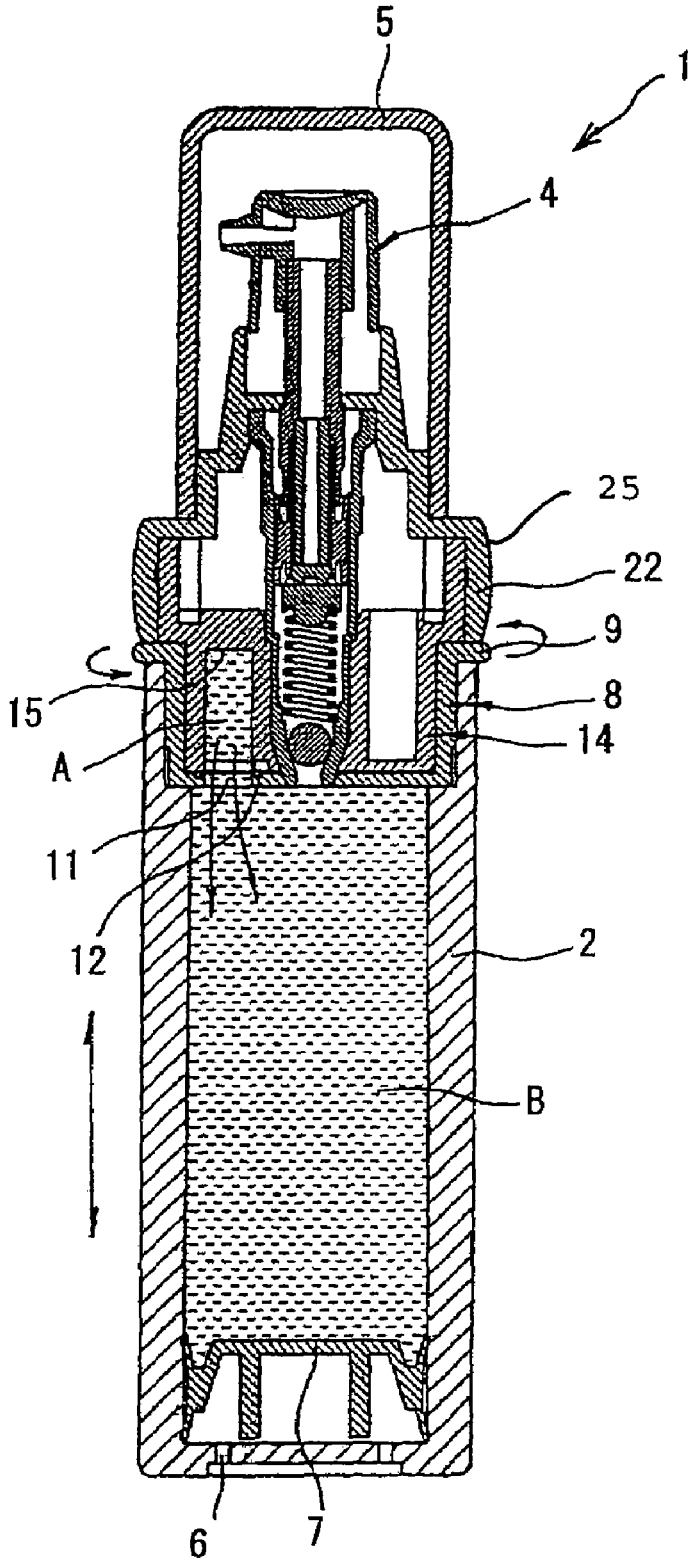
FIG. 13 is a vertical cross-sectional view showing the configuration when primary contents and supplementary contents are being mixed prior to use.
Figure 14:
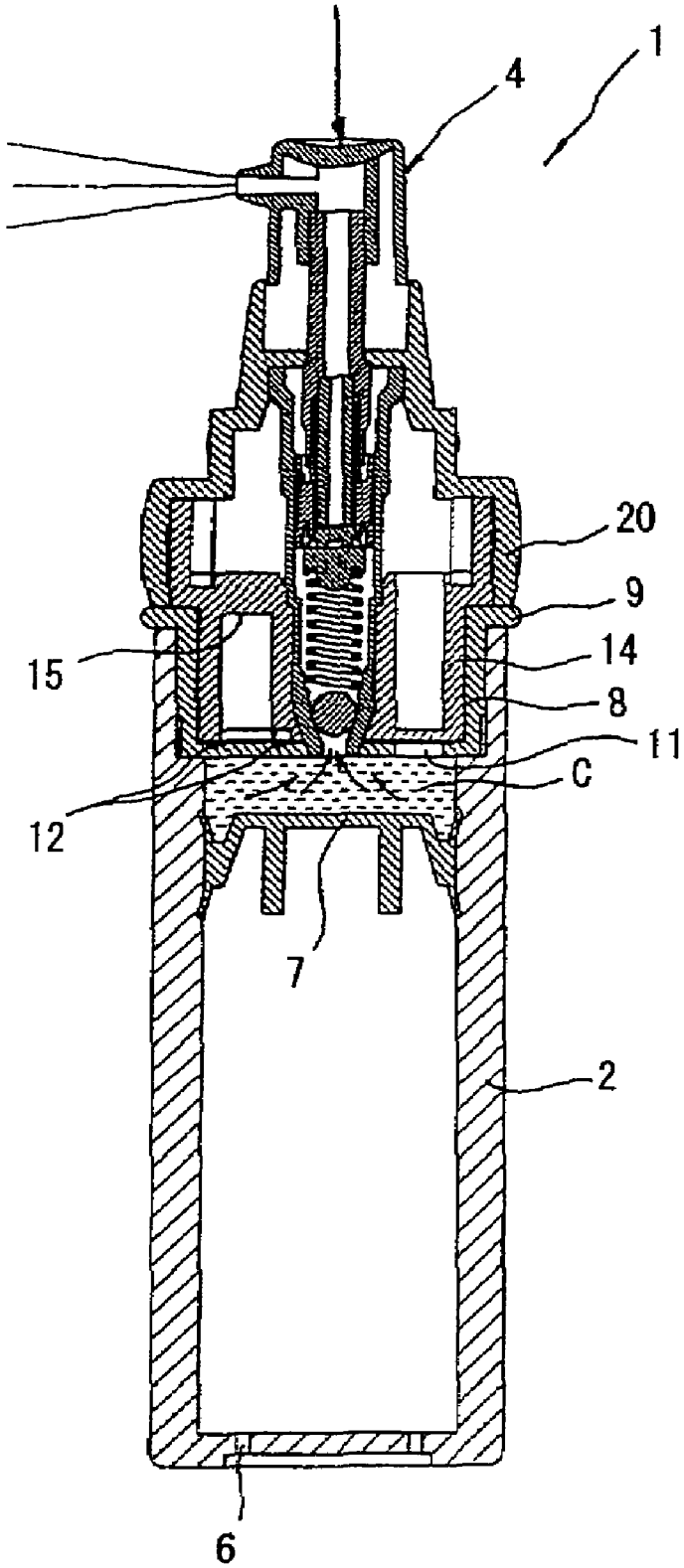
FIG. 14 is a vertical cross-sectional view showing the configuration at the time of use.
Figure 15:
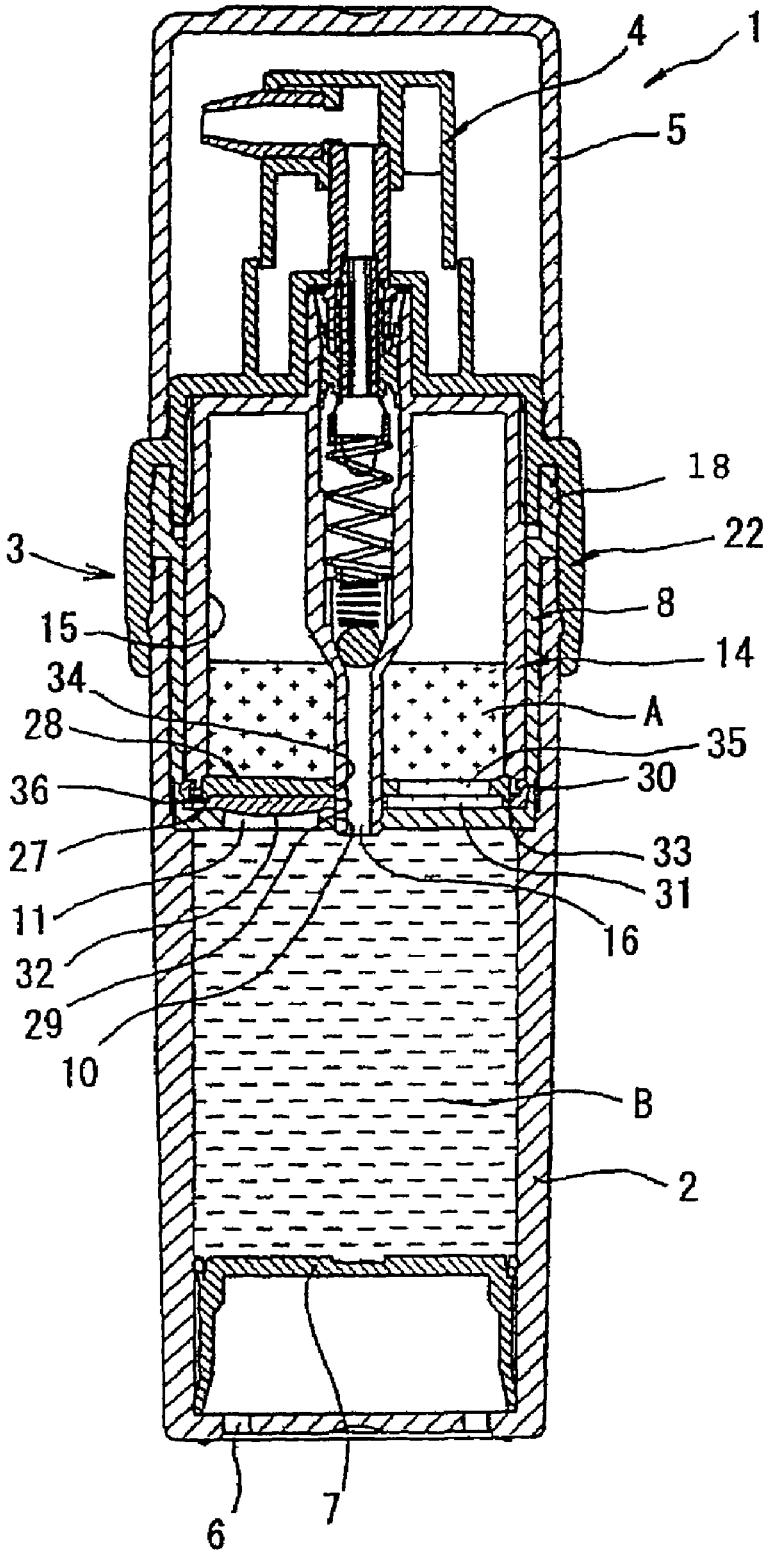
FIG. 15 is a vertical cross-sectional view illustrating the second embodiment of the present invention.
Figure 16:
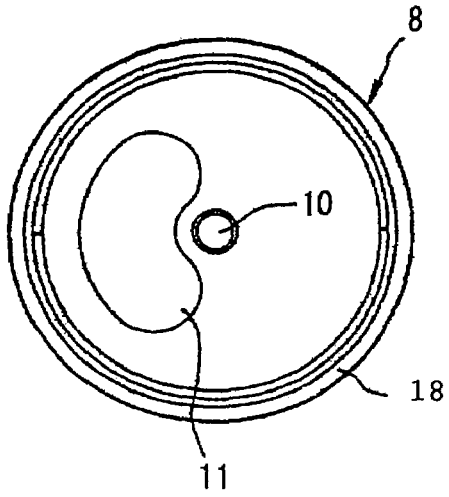
FIG. 16 is a plan view of a motion-support tube.
Figure 17:
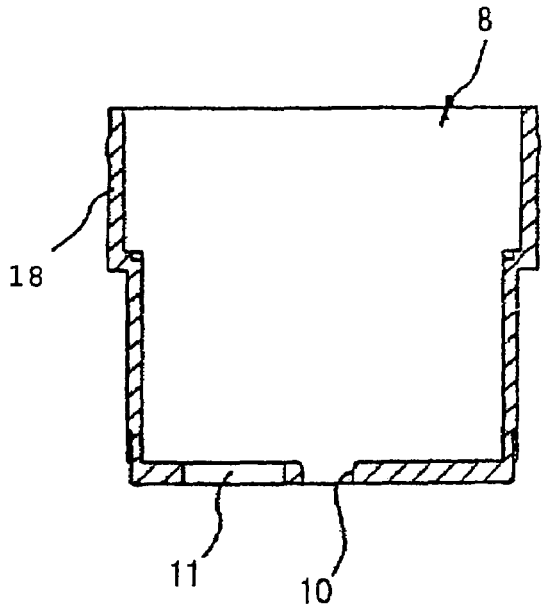
FIG. 17 is the vertical cross-sectional view thereof.
Figure 18:
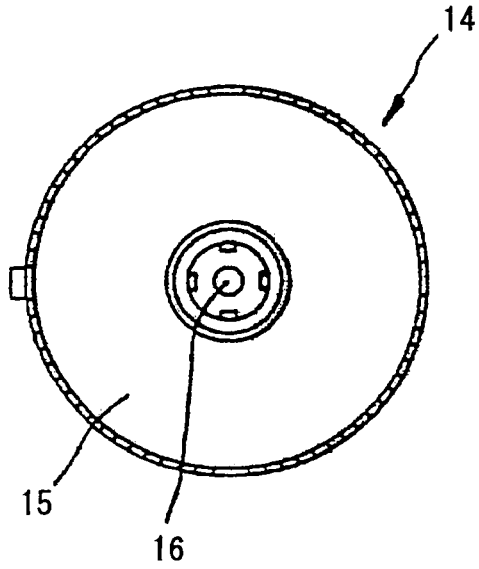
FIG. 18 is a plan view of a primary contents filling tube.
Figure 19:
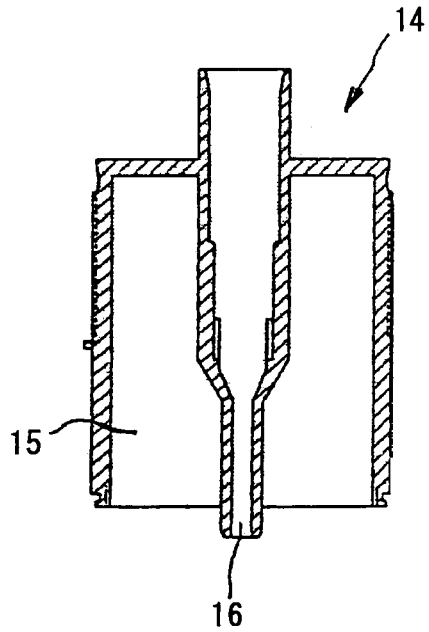
FIG. 19 is a vertical cross-sectional view thereof.
Figure 20:
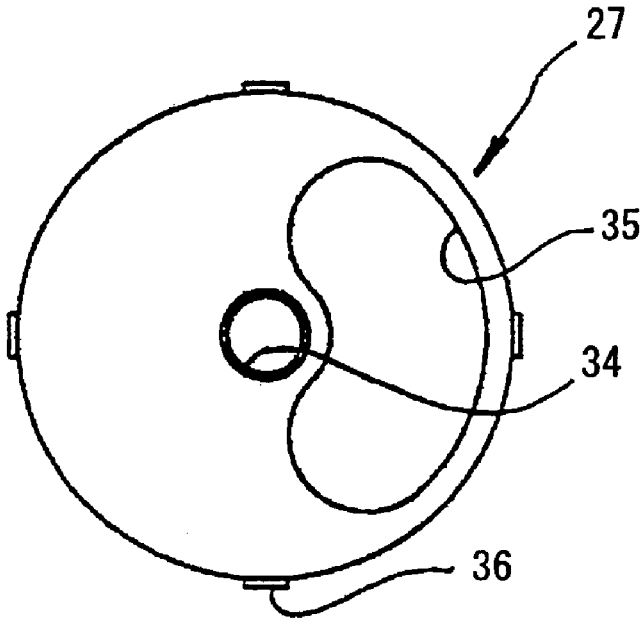
FIG. 20 is a plan view of a gasket adapter.
Figure 21:
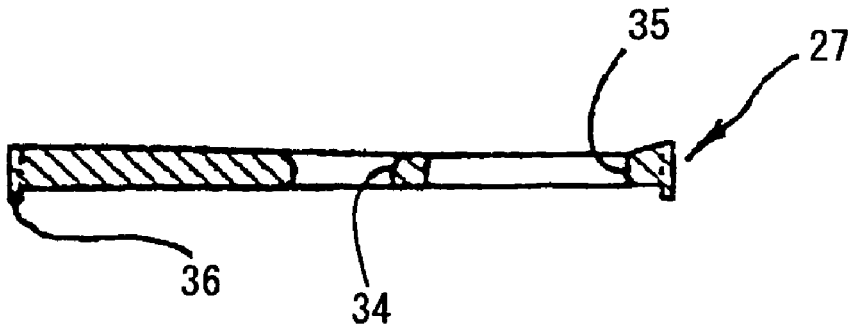
FIG. 21 is a vertical cross-sectional view thereof.
Figure 22:
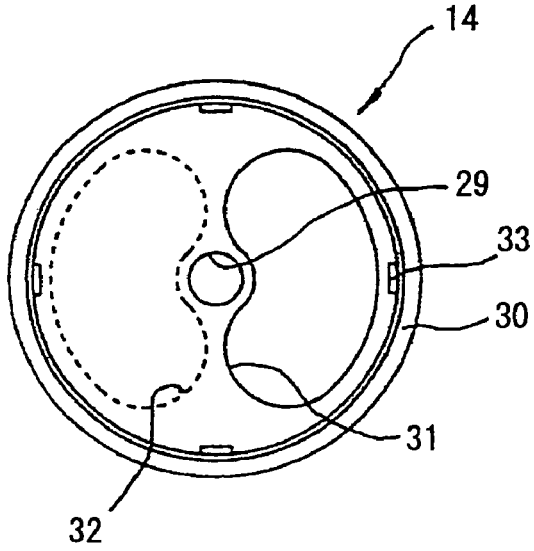
FIG. 22 is a plan view of a silicon gasket.
Figure 23:
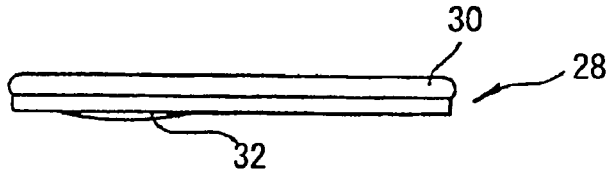
FIG. 23 is a side view thereof.
Figure 24:
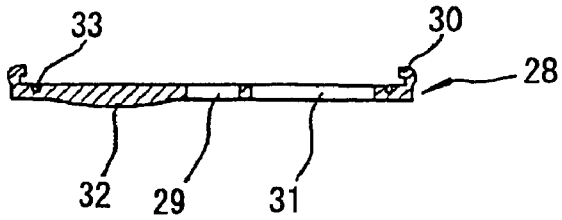
FIG. 24 is a vertical cross-sectional view thereof.
Figure 25:
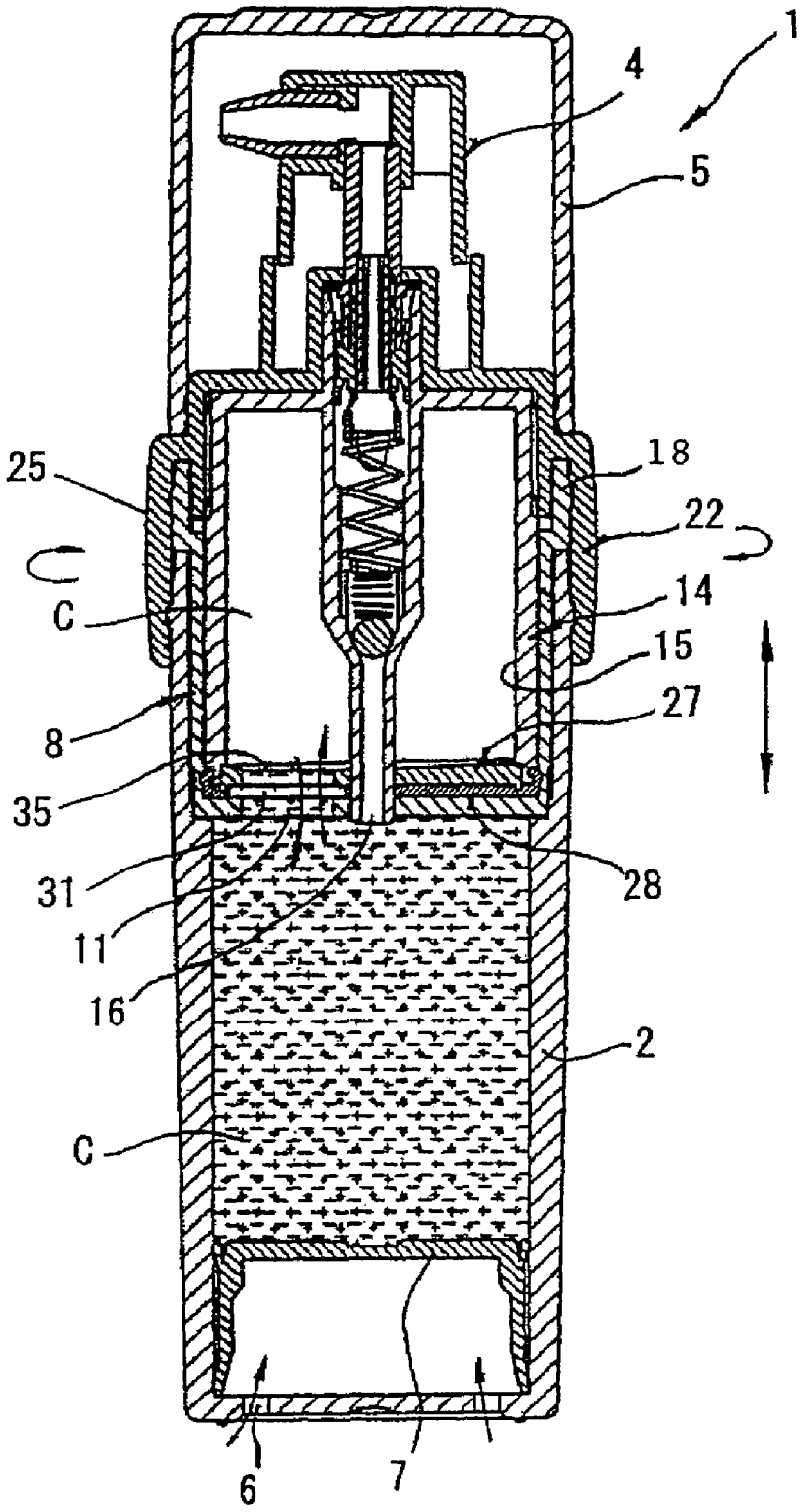
FIG. 25 is a vertical cross-sectional view showing the configuration at the time of mixing a primary contents and a supplementary contents prior to use.
Figure 26:
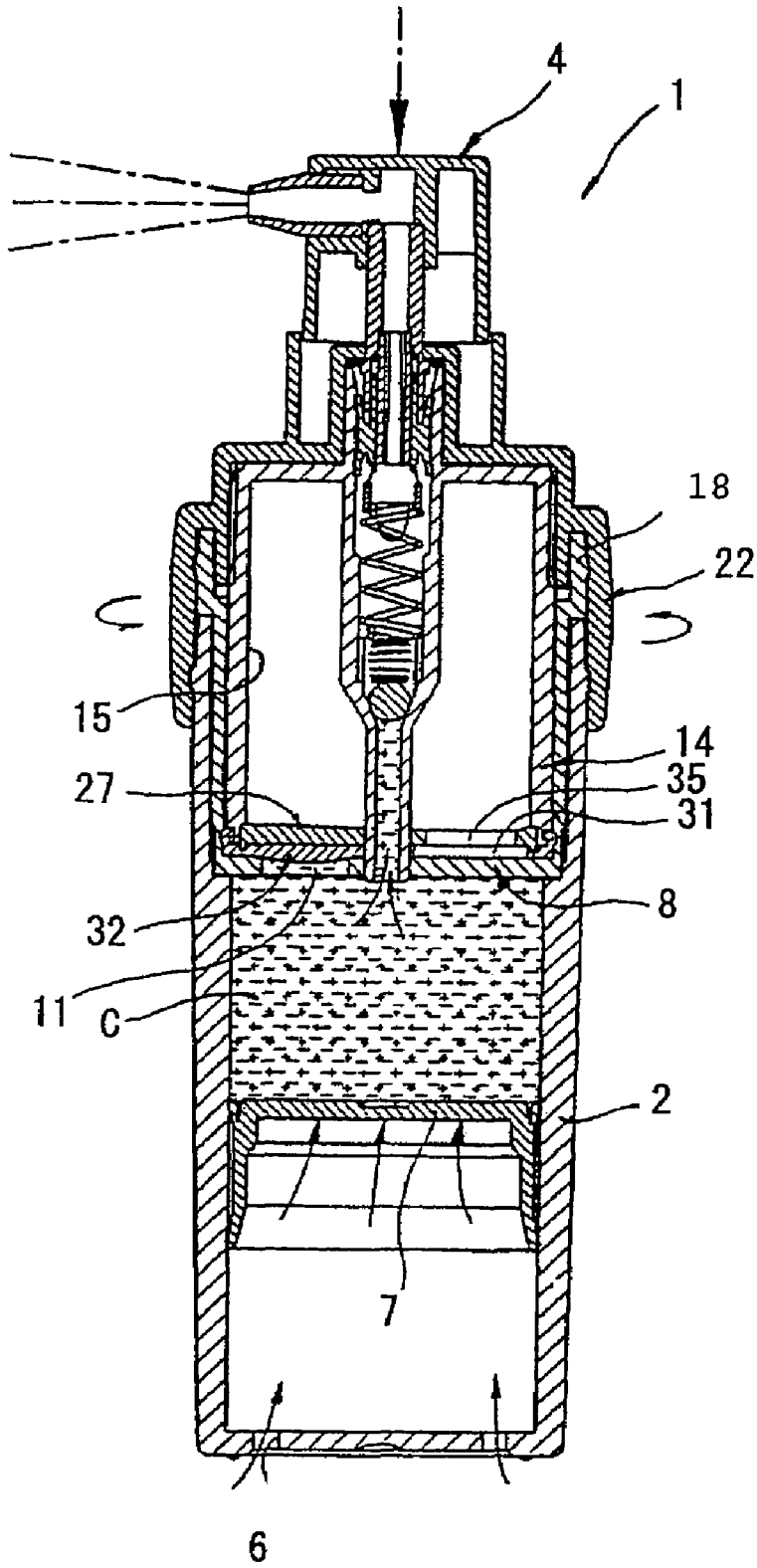
FIG. 26 is a vertical cross-sectional view showing the configuration at the time of use.
Figure 27:
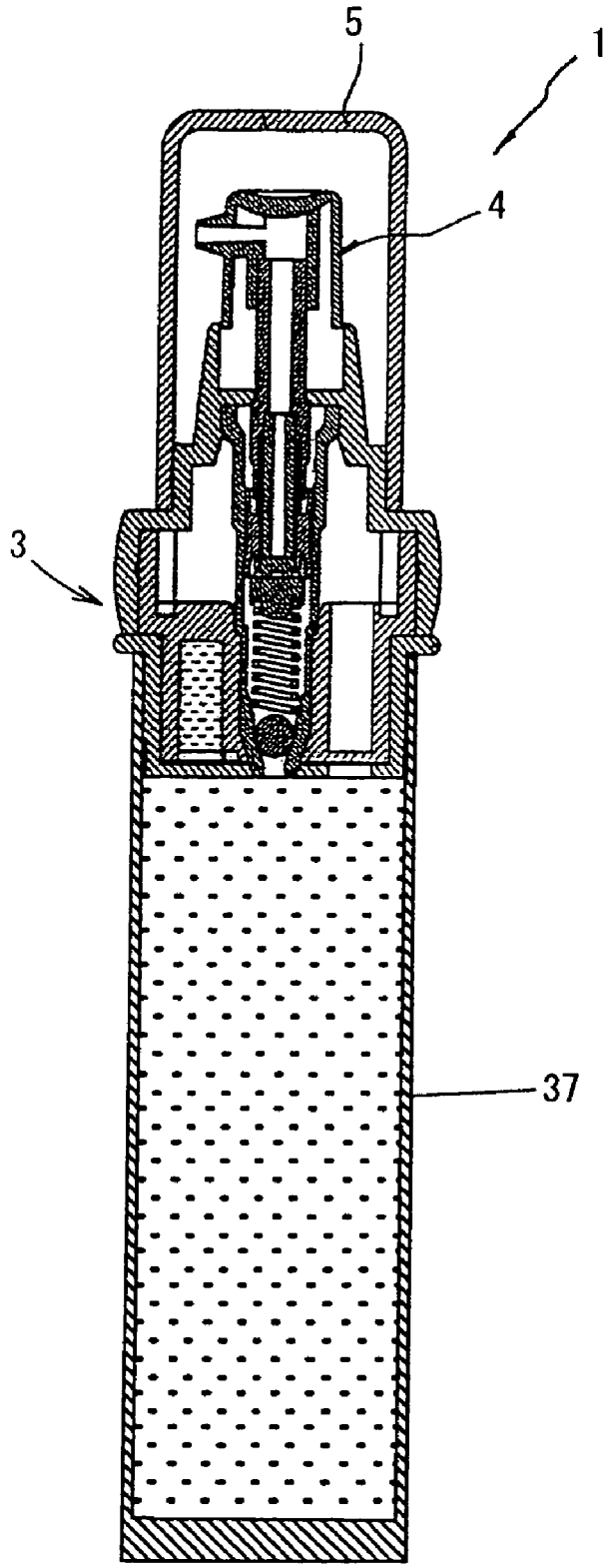
FIG. 27 is a vertical cross-sectional view illustrating the third embodiment of the present invention.

The invention claimed is:

1. A packaging container with contents-mixing structure, which is a pump container comprising a container body, a discharging pump and a movable bottom part and is configured so as to prevent the formation of an air layer within said container body by allowing said bottom part to move upward by a volume of contents discharged as a result of discharging of the contents by pumping operation, wherein said packaging container comprises a main container and an auxiliary container separated from said main container by a separating means, said separating means includes a communicating means which allows communication between said main container and said auxiliary container and is switchable between a separating state and a communicating state, so that contents of said auxiliary container flow into said main container to allow mixing of contents of the both containers during said communicating state.

2. The packaging container with contents mixing structure of claim 1, wherein said main container and said auxiliary container, respectively, are cylindrical containers separately formed, and are provided serially on a common center line, with a sealing member interposed therebetween, and have their respective openings facing each other, and are coaxially mutually rotatable, and matching and mismatching of the openings through the rotational operation allow switching between an open state and a closed state.

3. A packaging container with contents mixing structure, which is a pump container comprising a container body, a discharging pump and a movable bottom part and is configured so as to prevent the formation of an air layer within said container body by allowing said bottom part to move upward by a volume of contents discharged as a result of discharging of the contents by pumping operation, wherein said packaging container comprises a main container and an auxiliary container separated from said main container by a separating means, said separating means includes a communicating means which allows communication between said main container and said auxiliary container and is switchable between a separating state and a communicating state, wherein said separating state is maintained during the course of distribution, and said communication state is temporarily assumed at the time of use to allow contents of said auxiliary container to flow into said main container thereby to mix contents of the both containers, and then the communication state is switched back to said separating state during use.

4. The packaging container with contents mixing structure of claim 3, wherein said main container and said auxiliary container, respectively, are cylindrical containers separately formed, and are provided serially on a common center line, with a sealing member interposed therebetween, and have their respective openings facing each other, and are coaxially mutually rotatable, and matching and mismatching of the openings through the rotational operation allow switching between an open state and a closed state.

5. A packaging container with contents mixing structure, which is a pump container comprising a flexible container body and a discharging pump, wherein said container body has a level of elasticity which loses its restoring force by a negative pressure internally generated as a result of discharging of contents through pumping operation, wherein said packaging container comprises a main container and an auxiliary container separated from said main container by a separating means, said separating means includes a communicating means which allows communication between said main container and said auxiliary container and is switchable between a separating state and a communicating state, so that contents of said auxiliary container flow into said main container to allow mixing of contents of the both containers during said communicating state.

6. The packaging container with contents mixing structure of claim 5, wherein said main container and said auxiliary container, respectively, are cylindrical containers separately formed, and are provided serially on a common center line, with a sealing member interposed therebetween, and have their respective openings facing each other, and are coaxially mutually rotatable, and matching and mismatching of the openings through the rotational operation allow switching between an open state and a closed state.

7. A packaging container with contents mixing structure, which is a pump container comprising a flexible container body and a discharging pump, wherein said container body has a level of elasticity which loses its restoring force by a negative pressure internally generated as a result of discharging of contents through pumping operation, wherein said packaging container comprises a main container and an auxiliary container separated from said main container by a separating means, said separating means includes a communicating means which allows communication between said main container and said auxiliary container and is switchable between a separating state and a communicating state, wherein said separating state is maintained during the course of distribution, and said communicating state is temporarily assumed at the time of use to allow contents of said auxiliary container to flow into said main container thereby to mix contents of the both containers, and then the communicating state is switched back to said separating state during use.

8. The packaging container with contents mixing structure of claim 7, wherein said main container and said auxiliary container, respectively, are cylindrical containers separately formed, and are provided serially on a common center line, with a sealing member interposed therebetween, and have their respective openings facing each other, and are coaxially mutually rotatable, and matching and mismatching of the openings through the rotational operation allow switching between an open state and a closed state.

* * * * *